US007242898B2

(12) United States Patent
Kawahata

(10) Patent No.: US 7,242,898 B2
(45) Date of Patent: Jul. 10, 2007

(54) FIXING UNIT IMAGE FORMING APPARATUS WITH INTERIOR CROWN-SHAPED ROLL

(75) Inventor: Yasushi Kawahata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/219,806

(22) Filed: Sep. 7, 2005

(65) Prior Publication Data

US 2006/0198671 A1 Sep. 7, 2006

(30) Foreign Application Priority Data

Mar. 2, 2005 (JP) ..... P2005-057033

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 4,963,084 A * 10/1990 Froeschke ..... 425/331

FOREIGN PATENT DOCUMENTS

| | | | |
|---|---|---|---|
| JP | 58062679 A | * | 4/1983 |
| JP | 61185777 A | * | 8/1986 |
| JP | 06208312 A | * | 7/1994 |
| JP | 08278709 A | * | 10/1996 |
| JP | 11038811 A | * | 2/1999 |
| JP | 3084692 | | 7/2000 |
| JP | 2004109454 A | * | 4/2004 |
| JP | 2005309188 A | * | 11/2005 |

* cited by examiner

*Primary Examiner*—Quana Grainger
(74) *Attorney, Agent, or Firm*—Morgan, Lewis & Bockius LLP

(57) ABSTRACT

A fixing unit that fixes a toner image carried on a recording medium includes a rotation member, and a pressure belt module that is provided with a pressure belt, a pressure roller supporting the pressure belt and pressing the rotation member, and a belt-supporting roller supporting the pressure belt. The pressure roller includes a first roller that is formed into a cylindrical shape, and a second roller that is disposed inside the first roller and formed into a crown shape, in which an axially central portion thereof is larger in outer diameter than both end portions thereof.

18 Claims, 7 Drawing Sheets

FIXING UNIT IMAGE FORMING APPARATUS WITH INTERIOR CROWN-SHAPED ROLL

BACKGROUND OF THE INVENTION

1. Field of the Invention

The present invention relates to a fixing unit and roller member for use in an image forming apparatus using, for example, an electrophotographic method.

2. Description of the Related Art

In an image forming apparatus such as a copy machine and a printer which use an electrophotographic method, a photoreceptor that is drum-shaped for example (photoreceptor drum) is uniformly charged, and this photoreceptor drum is scan exposed by light controlled based on image information, thus forming an electrostatic latent image on the photoreceptor drum. And, this electrostatic latent image is converted into a visible image (toner image) using toner, and after directly transferred to recording paper from on the photoreceptor drum, or after once primary-transferred to an intermediate transfer body and then secondary-transferred to the recording paper from the intermediate transfer body, this toner image is fixed to the recording paper by a fixing unit.

The fixing unit for use in such an image forming apparatus includes, for example, a fixing roller and a pressure roller. The fixing roller, having a heating source disposed within a cylindrical core metal, is formed by laminating on the core metal a heat-resistant elastic layer and a release layer. The pressure roller, disposed in pressure contact with this fixing roller, is formed by laminating on the core metal a heat-resistant elastic layer and a release layer of heat-resistant resin film or heat-resistant rubber film. And, recording paper bearing an unfixed toner image is passed between the fixing roller and the pressure roller to heat and pressurize the unfixed toner image, thereby fixing a toner image to the recording paper. Such a fixing unit, which is of so-called roller-nip method, is widely used.

In the meantime, for an increase in speed in the fixing unit of roller-nip method, to supply a sufficient amount of heat to the toner and the recording paper, it is necessary to increase a nip width in proportion to a fixing speed. As the method of increasing the nip width, there are the method of increasing a load between the fixing roller and the pressure roller, the method of increasing the thickness of an elastic body, and further the method of increasing a roller diameter.

However, in the method of increasing the load and the method of increasing the thickness of the elastic body, roller deflection makes the shape of the nip width nonuniform along a roller axis, thereby causing a problem which may affect image quality, such as the occurrence of variations in fixability or cockles in paper. Besides, in the method of increasing the roller diameter, there is the problem of involving an increase in size of the apparatus and of lengthening a period of time (warm-up time) required to increase a roller temperature from a room temperature to a fixable temperature.

Thereupon, to solve these problems to realize a fixing unit responsive to an increase in speed of the image forming apparatus, the present applicant provides technology for a fixing unit of the following configuration (e.g., see Japanese Patent No. 3084692). That is, the fixing unit includes a fixing roller having an elastic body coated on a surface thereof and an endless belt stretched over plural support rollers, wherein the endless belt is wrapped a predetermined angle region around the fixing roller so as to form a nip region between the endless belt and the fixing roller. At the same time, disposed in an exit portion (the most downstream portion) of the nip region is a pressure roller that locally applies thereto higher pressure than any other portion of the nip region.

In such a fixing unit described in the Japanese Patent No. 3084692, the endless belt stretched over the plural rollers is brought into contact with the fixing roller, thereby forming a nip portion (which is also called a "belt-nip portion"). By adopting such a configuration (which is also called a "belt-nip method"), the width of the belt-nip portion formed by the fixing roller and the endless belt can be easily made larger than the width of the related-art roller-nip portion between the fixing roller and the pressure roller. This enables a response to the increase in speed and also facilitates a reduction in size of the apparatus.

Particularly, in the fixing unit of belt-nip method, the heat capacity of the endless belt brought into pressure contact with the fixing roller is low, so that heat transferred from the fixing roller is also difficult to diffuse. Consequently, even when the rotation of the fixing roller is started, the amount of heat drawn from the fixing roller to the endless belt side is comparatively small, thus increasing efficiency in the use of heat for fusing toner. Therefore, this fixing unit also has the advantage of being capable of improving toner fixability.

In the meantime, the fixing unit of belt-nip method as described in the aforesaid Japanese Patent No. 3084692 is configured such that one of the rollers having the endless belt stretched thereover presses against the fixing roller (fixing member) in the most downstream portion of the nip portion formed by the fixing roller and the endless belt. Thereby, such a roller is made to function as a pressure roller (pressure member) and thus is set to locally apply, to the most downstream portion, higher pressure than any other portion of the nip portion. By adopting such a configuration, it follows that the pressure roller applies local pressure to a toner image being heated and fused in the nip portion. Consequently, the fixability of the toner image passed through the nip portion is improved, and particularly the surface of the toner image before solidified is smoothed, thus imparting proper gloss to the toner image.

However, the pressure roller, which presses against the fixing roller in the most downstream portion of the nip portion, has the endless belt stretched therearound on an axially lateral peripheral surface thereof. Consequently, to set such a pressure roller to press toward the fixing roller side, it is necessary to adopt the configuration of pressing the fixing roller from both end portions of the pressure roller. However, in the configuration in which the pressure roller thus presses the fixing roller from the both end portions thereof, arcuate deflection occurs in the pressure roller (even in the fixing roller as the case may be). Therefore, there is the structural problem in which the pressure between the pressure roller and the fixing roller decreases toward an axially central portion of the pressure roller, so that nonuniformity in axial pressure is likely to occur.

Consequently, a declining trend of fixability occurs across a central portion of the recording paper, thus causing the disadvantage of a reduction in image quality. Besides, particularly, there occur so-called gloss variations in which the gloss level of the toner image decreases toward the central portion of the recording paper. Thus, there is the disadvantage that the reduction in image quality is conspicuous in a solid image such as a photographic image.

SUMMARY OF THE INVENTION

According to an aspect of the invention, a fixing unit that fixes a toner image carried on a recording medium includes a rotation member and a pressure belt module that is provided with a pressure belt, a pressure roller supporting the pressure belt and pressing the rotation member, and a belt-supporting roller supporting the pressure belt. The pressure roller includes a first roller that is formed into a cylindrical shape, and a second roller that is disposed inside the first roller and formed into a crown shape, in which an axially central portion thereof is larger in outer diameter than both end portions thereof.

DETAILED DESCRIPTION OF THE INVENTION

Embodiments of the invention will be described with reference to the drawings.

First Embodiment

Figure 1:
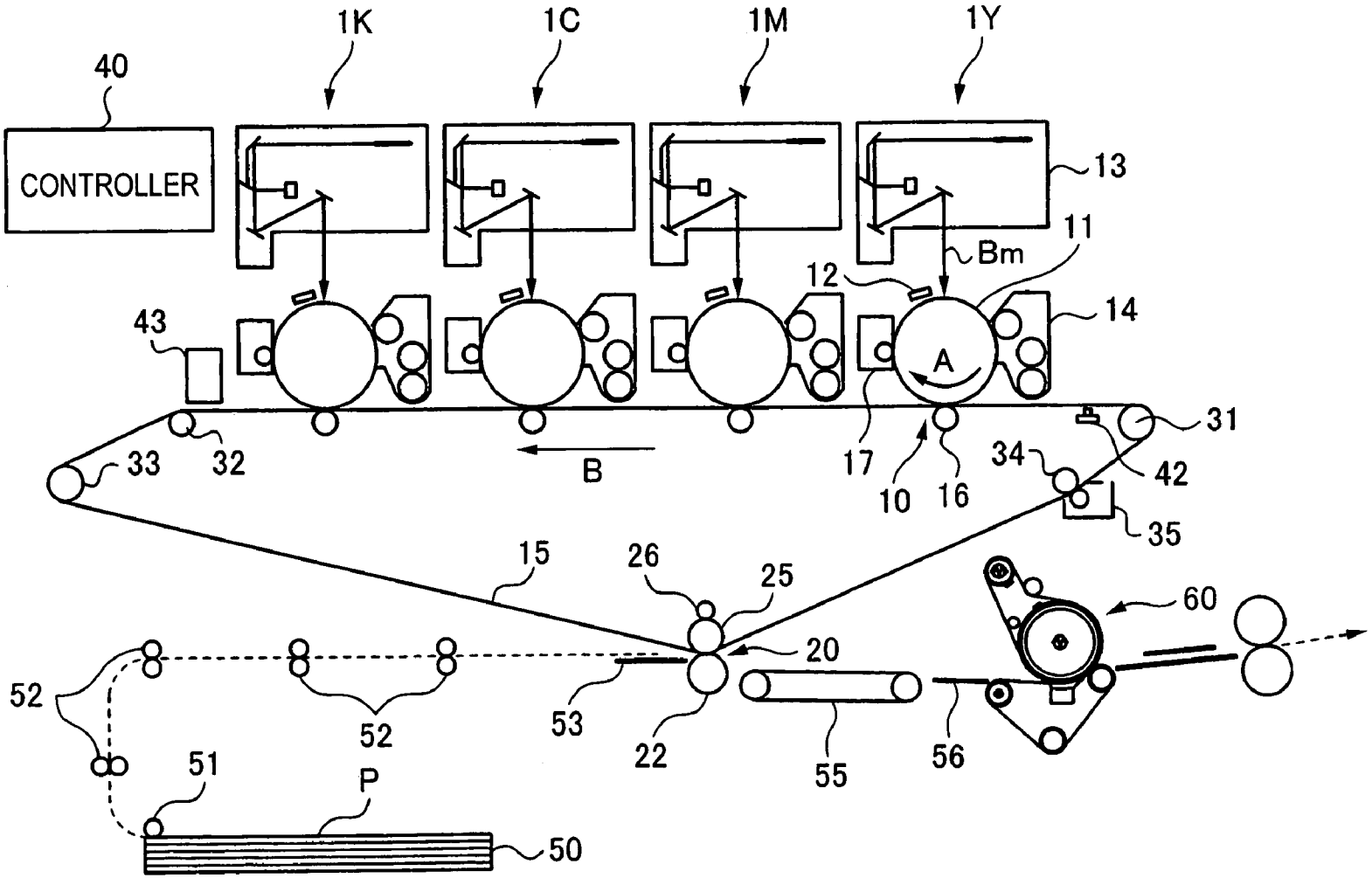
FIG. 1 is a schematic configuration diagram showing an image forming apparatus of the invention.

FIG. 1 is a schematic configuration diagram showing an image forming apparatus to which a first embodiment is applied. The image forming apparatus shown in FIG. 1, which is a generally called tandem type of intermediate-transfer image forming apparatus, includes plural image forming units 1Y, 1M, 1C, and 1K, primary transfer sections 10, a secondary transfer section 20, and a fixing unit 60. The image forming units 1Y, 1M, 1C, and 1K form respective color component toner images by an electrophotographic method. The primary transfer sections 10 sequentially transfer (primary-transfer) to an intermediate transfer belt 15 the color component toner images formed by the image forming units 1Y, 1M, 1C, and 1K. The secondary transfer section 20 collectively transfers (secondary-transfers) superimposed toner images transferred onto the intermediate transfer belt 15, to sheet P serving as a recording medium (recording paper). And, the fixing unit 60 fixes a secondary-transferred image onto the sheet P. The image forming apparatus has a controller 40 that controls the operation of each device (each section).

In the first embodiment, the image forming units 1Y, 1M, 1C, and 1K each have electrophotographic devices disposed around a photoreceptor drum 11 rotating in the direction of arrow A, such as a charging device 12, a laser exposure device 13, a developing device 14, a primary transfer roller 16, and a drum cleaner 17. The charging device 12 charges the photoreceptor drum 11. The laser exposure device 13 writes an electrostatic latent image onto the photoreceptor drum 11 (in the figure, an exposure beam is indicated by reference character Bm). The developing device 14, having stored therein each color component toner, uses the toner to convert the electrostatic latent image on the photoreceptor drum 11 into a visible image. The primary transfer roller 16, in the primary transfer section 10, transfers to the intermediate transfer belt 15 the color component toner image formed on the photoreceptor drum 11. And, the drum cleaner 17 cleans up residual toner on the photoreceptor drum 11. These image forming units 1Y, 1M, 1C, and 1K are substantially linearly disposed in the following order from upstream to downstream of the intermediate transfer belt 15: yellow (Y), magenta (M), cyan (C), and black (K).

The intermediate transfer belt 15 serving as an intermediate transfer body is configured of a film-like endless belt that has an appropriate amount of antistatic agent, such as carbon black, contained in a resin such as polyimide or polyamide. And, the intermediate transfer belt 15 is formed to have a volume resistivity of $10^6$ to $10^{14}$ Ωcm, and is configured to have a thickness, for example, of the order of 0.1 mm. The intermediate transfer belt 15 is cyclically moved (rotated) by various rollers at a predetermined speed in the direction B shown in FIG. 1. The intermediate transfer belt 15 has as these various rollers a drive roller 31, a support roller 32, a tension roller 33, a backup roller 25, and a cleaning backup roller 34. The drive roller 31 is driven by a motor (not shown) with an excellent constancy of speed to rotate the intermediate transfer belt 15. The support roller 32 supports the intermediate transfer belt 15 that extends substantially linearly along the direction in which the photoreceptor drums 11 are disposed. The tension roller 33 applies a constant tension to the intermediate transfer belt 15 and functions as a correction roller that prevents the intermediate transfer belt 15 from meandering. The backup roller 25 is disposed in the secondary transfer section 20. And, the cleaning backup roller 34 is disposed in a cleaning section that scrapes off residual toner on the intermediate transfer belt 15.

The primary transfer section 10 is configured of the primary transfer roller 16 that is disposed opposite the photoreceptor drum 11 with the intermediate transfer belt 15 sandwiched therebetween. The primary transfer roller 16 is configured of a shaft and a sponge layer that, serving as an elastic layer, is fixed to the periphery of the shaft. The shaft is a cylindrical rod made of metal such as iron or SUS. The sponge layer is a sponge-like cylindrical roller that, having a volume resistivity of $10^7$ to $10^9$ Ωcm, is formed of blend rubber of NBR, SBR, and EPDM combined with a conductive agent such as carbon black. And, the primary transfer roller 16 is disposed in pressure contact with the photoreceptor drum 11 with the intermediate transfer belt 15 sandwiched therebetween. Furthermore, the configuration is such that a voltage (primary transfer bias) of opposite polarity to the charging polarity of toner (which is set to a negative polarity, and the same shall apply hereinafter) is applied to the primary transfer roller 16. This provides a configuration such that the toner images on the photoreceptor drums 11 are sequentially electrostatically attracted to the intermediate transfer belt 15 to form superimposed toner images on the intermediate transfer belt 15.

The secondary transfer section 20 includes: a secondary transfer roller 22 disposed on the side of a toner image bearing surface of the intermediate transfer belt 15; and the backup roller 25. The backup roller 25 has the surface configured of a tube of blend rubber of EPDM and NBR dispersed with carbon and has the inside configured of EPDM rubber. And, the backup roller 25 is formed to have a surface resistivity of $10^7$ to $10^{10}$ Ω/square and is set to have a hardness of, for example, 70° (Asker C). This backup roller 25 is disposed on the rear surface side of the intermediate transfer belt 15 to provide the opposite electrode of the secondary transfer roller 22, and has disposed in abutment therewith a metal feeder roller 26 to which a secondary transfer bias is stably applied.

On the other hand, the secondary transfer roller 22 is configured of a shaft and a sponge layer that, serving as an elastic layer, is fixed to the periphery of the shaft. The shaft is a cylindrical rod made of metal such as iron or SUS. The sponge layer is a sponge-like cylindrical roller that, having a volume resistivity of $10^7$ to $10^9$ Ωcm, is formed of blend rubber of NBR, SBR, and EPDM combined with a conductive agent such as carbon black. And, the secondary transfer roller 22 is disposed in pressure contact with the backup roller 25 with the intermediate transfer belt 15 sandwiched therebetween. Furthermore, the secondary transfer roller 22 is grounded to form the secondary transfer bias with respect to the backup roller 25, thus secondary-transferring the toner images onto the sheet P transported to the secondary transfer section 20.

An intermediate transfer belt cleaner 35 is disposed downstream of the secondary transfer section 20 of the intermediate transfer belt 15 so as to be freely brought into and out of contact with the intermediate transfer belt 15. The intermediate transfer belt cleaner 35 removes residual toner and paper dust on the intermediate transfer belt 15 after the secondary transfer and cleans the outer surface of the intermediate transfer belt 15. On the other hand, a reference sensor (home position sensor) 42, which generates a reference signal to provide a reference for timing image formation of the image forming units 1Y, 1M, 1C, and 1K, is disposed upstream of the yellow image forming unit 1Y. An image density sensor 43 for making an image adjustment is disposed downstream of the black image forming unit 1K. This reference sensor 42 generates the reference signal by recognizing a predetermined mark provided on the backside of the intermediate transfer belt 15. And, the image forming units 1Y, 1M, 1C, and 1K are configured to start their image formation in response to a directive issued by the controller 40 based on recognition of this reference signal.

The image forming apparatus of this embodiment includes as a paper transport system a paper tray 50, a pickup roller 51, a transport roller 52, a transport shoot 53, a transport belt 55, and a fixing entrance guide 56. The paper tray 50 stores the sheet P. The pickup roller 51 picks up and transports the sheet P accumulated on this paper tray 50 with predetermined timing. The transport roller 52 transports the sheet P brought forward by the pickup roller 51. The transport shoot 53 transports into the secondary transfer section 20 the sheet P transported by the transport roller 52. The transport belt 55 transports to the fixing unit 60 the sheet P transported after the toner images are secondary-transferred thereto by the secondary transfer roller 22. The fixing entrance guide 56 leads the sheet P to the fixing unit 60.

The basic image forming process of the image forming apparatus of this embodiment will now be described. In the image forming apparatus as shown in FIG. 1, image data outputted from a not-shown image reader (IIT), a not-shown is personal computer (PC), etc. is subjected to a predetermined image process by a not-shown image processing device (IPS), and thereafter an image forming operation is executed by the image forming units 1Y, 1M, 1C, and 1K. In the IPS, inputted reflectance data is subjected to a predetermined image process, such as shading correction, displacement correction, luminance/color space conversion, gamma correction, frame deletion/color edition, and movement edition. The image data subjected to the image process is converted to color material gradation data of four colors Y, M, C, and K, and the color material gradation data are outputted to the laser exposure device 13.

In the laser exposure device 13, in response to the inputted color material gradation data, the photoreceptor drums 11 of the image forming units 1Y, 1M, 1C, and 1K are irradiated with the exposure beams Bm emerging from semiconductor lasers for example. In the photoreceptor drums 11 of the image forming units 1Y, 1M, 1C, and 1K, after charged by the charging devices 12, the surfaces thereof are scan exposed by these laser semiconductor lasers to form electrostatic latent images. The formed electrostatic latent images are developed by the image forming units 1Y, 1M, 1C, and 1K to provide Y, M, C, and K color toner images.

The toner images formed on the photoreceptor drums 11 of the image forming units 1Y, 1M, 1C, and 1K are transferred onto the intermediate transfer belt 15 in the primary transfer sections 10 where the photoreceptor drums 11 abut the intermediate transfer belt 15. More specifically, in the primary transfer sections 10, primary transfer is performed such that the voltage (primary transfer bias) of opposite polarity to the charging polarity (negative polarity) of toner is applied by the primary transfer rollers 16 to a base material of the intermediate transfer belt 15, thus sequentially superimposing the toner images onto the front surface of the intermediate transfer belt 15.

After the toner images are sequentially primary-transferred onto the front surface of the intermediate transfer belt 15, the intermediate transfer belt 15 is moved to convey the toner images to the secondary transfer section 20. When the toner images are conveyed to the secondary transfer section 20, then in the paper transport system, the pickup roller 51 rotates in time with the conveyance of the toner images to the secondary transfer section 20, thus feeding the sheet P of predetermined size from the paper tray 50. The sheet P fed by the pickup roller 51 is transported by the transport roller 52, passes through the transport shoot 53, and reaches the secondary transfer section 20. The sheet P is stopped before reaching this secondary transfer section 20, and a resist roller (not shown) rotates in time with the movement of the intermediate transfer belt 15 bearing the toner images, thereby aligning the position of the sheet P with the position of the toner images.

In the secondary transfer section 20, the secondary transfer roller 22 is pressed via the intermediate transfer belt 15 against the backup roller 25. At this time, the sheet P transported in time therewith is nipped between the intermediate transfer belt 15 and the secondary transfer roller 22. On this occasion, when a voltage (secondary transfer bias) of the same polarity as the charting polarity (negative polarity) of toner is applied from the power supply roller 26, a transfer electric field is formed between the secondary transfer roller 22 and the backup roller 25. And, unfixed toner images supported on the intermediate transfer belt 15 are collectively electrostatically transferred onto the sheet P in the secondary transfer section 20 where they are pressed between the secondary transfer roller 22 and the backup roller 25.

Thereafter, the sheet P having the toner images electrostatically transferred thereto is transported by the secondary transfer roller 22, as being separated from the intermediate transfer belt 15, intact to the transport belt 55 disposed downstream of the secondary transfer roller 22 in the direction of paper transport. The transport belt 55 transports the sheet P to the fixing unit 60 in accordance with the optimum transport speed of the fixing unit 60. The unfixed toner images on the sheet P transported to the fixing unit 60 are subjected to a fixing process under heat and pressure by the fixing unit 60, and thereby are fixed onto the sheet P. And, the sheet P having a fixed image formed thereon is transported to a discharged paper receptacle disposed in a discharge section of the image forming apparatus.

On the other hand, after completion of the transfer to the sheet P, residual toner remaining on the intermediate transfer belt 15 is conveyed to the cleaning section with the rotation of the intermediate transfer belt 15 and then removed from on the intermediate transfer belt 15 by the cleaning backup roller 34 and the intermediate transfer belt cleaner 35.

The fixing unit 60 for use in the image forming apparatus of this embodiment will now be described.

Figure 2:
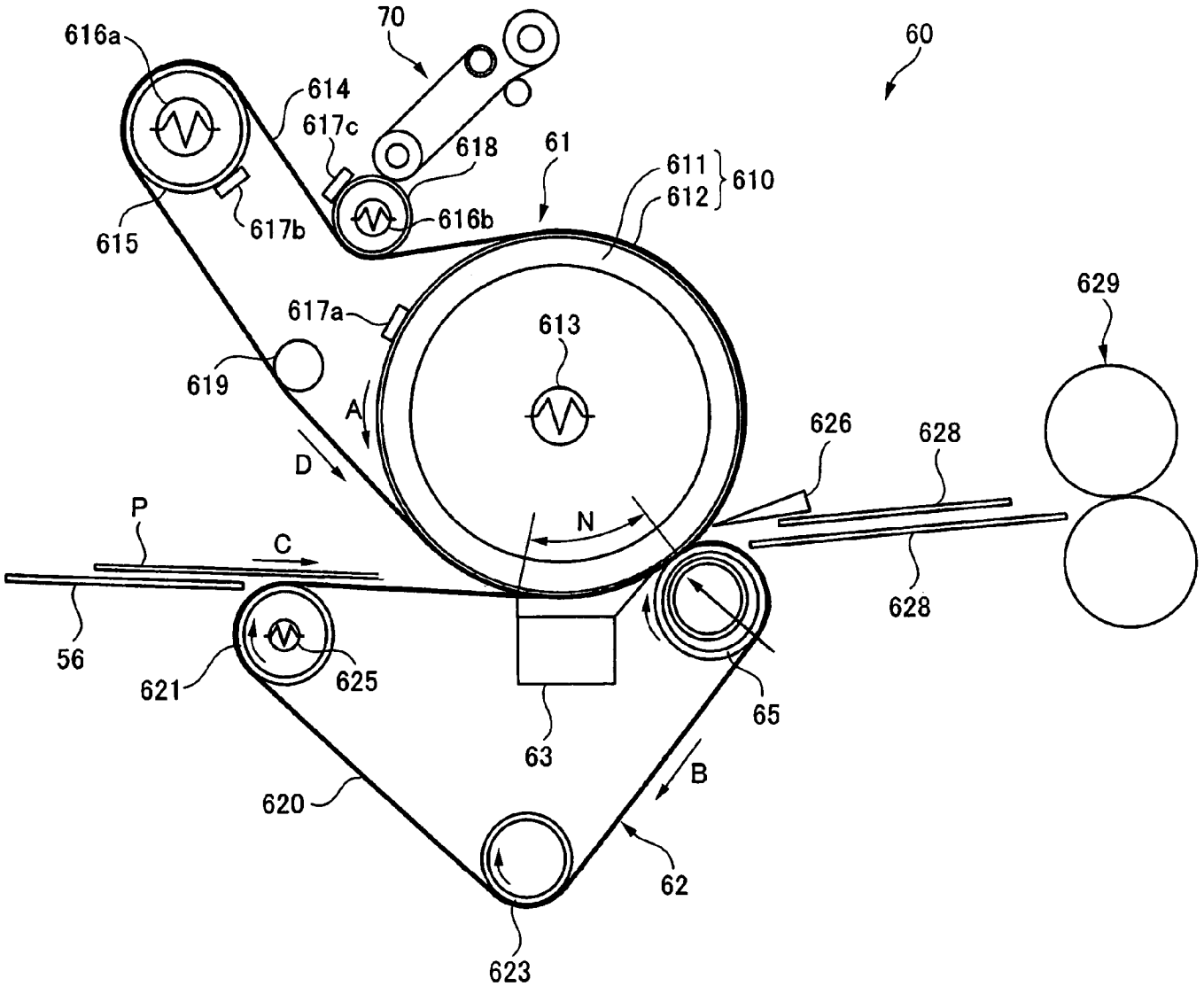
FIG. 2 is a sectional side view showing the configuration of a fixing unit according to a first embodiment.

FIG. 2 is a sectional side view showing the configuration of the fixing unit 60 of this embodiment. This fixing unit 60 has its main portion configured of: a fixing belt module 61 as an example of a heating member; and a pressure belt module 62 as an example of a pressure contact member that is configured capable of being in and out of contact with the fixing belt module 61.

The fixing belt module 61 includes a fixing roller 610, a belt-supporting roller 615, a belt-supporting roller 618, a support roller 619, and a fixing belt 614. The fixing roller 610 rotates in the direction of arrow A. The belt-supporting roller 615 has disposed therewithin a halogen heater 616*a* serving as the heating member. The belt-supporting roller 618 similarly has disposed therewithin a halogen heater 616*b* serving as the heating member. The support roller 619 supports the fixing belt 614 between the fixing roller 610 and the belt-supporting roller 615. And, the fixing belt 614 is moved in the direction of arrow D as being stretched over the fixing roller 610, belt-supporting roller 615, and belt-supporting roller 618, and further over the support roller 619.

The fixing roller 610 is a soft roller of 65 mmϕ outer diameter and 420 mm length which is formed by coating a 1.5 mm thick elastic layer 612 on the surface of a core metal 611 formed of 5 mm thick aluminum. The elastic layer 612 uses LSR (Liquid Silicone Rubber) having a rubber hardness of 25 to 45° (JIS-A). And, the fixing roller 610 rotates in the direction of arrow A at a surface speed of 400 mm/s.

A rated 1000 W halogen heater 613 is disposed as a heating source within the fixing roller 610. And, the controller 40 (see FIG. 1) of the image forming apparatus controls the surface temperature of the fixing roller 610 to 160° C., based on the measurement value of a temperature sensor 617*a* that is disposed in contact with the surface of the fixing roller 610.

Additionally, the material of the elastic layer 612 is not limited to silicone rubber, but can use heretofore known various materials such e.g. as fluorocarbon rubber. Besides, an elastic layer, in which plural layers made up of silicone rubber and fluorocarbon rubber are laminated together, may be used as the elastic layer 612. Furthermore, the fixing roller 610 can use a so-called hard roller without using the elastic layer 612, in which case heat supply from the fixing roller 610 to the fixing belt 614 is made more efficient.

The fixing belt 614 is supported at a tension of 10 kgf by the fixing roller 610, belt-supporting roller 615, and belt-supporting roller 618, and further by the support roller 619. The fixing belt 614 is formed of a flexible endless belt of 330 mm circumference and 400 mm width.

The fixing belt 614 is configured of a multilayer structure including a base layer, an elastic layer, and a surface layer. The base layer is formed of a 75 μm thick polyimide resin. The elastic layer is made up of 200 μm thick silicone rubber laminated on the surface side (outer surface side) of the base layer. And, further on the elastic layer, the surface layer is formed of a 30 μm thick tetrafluoroethylene-perfluoroalkylvinylether copolymer resin (PFA) as a release layer. Here, the elastic layer is provided particularly for an improvement in image quality of a color image and, in this embodiment, uses silicone rubber having a rubber hardness of 20° (JIS-A). Additionally, a material, a thickness, a hardness, etc. can be appropriately selected for the configuration of the fixing belt 614 in response to apparatus design conditions such as an intended use and a use condition.

The belt-supporting roller 615 is formed of a stainless pipe roller of 23 mmϕ outer diameter, 2 mm wall thickness, and 420 mm length. A rated 800 W halogen heater 616 is disposed as a heating source within the belt-supporting roller 615, and the surface temperature of the belt-supporting roller 615 is controlled to 200° C. by a temperature sensor 617*b* and the control section (see FIG. 1). Accordingly, the belt-supporting roller 615 has the function of heating the fixing belt 614, combined with the function of supporting the fixing belt 614.

Besides, to minimize axial displacement of the fixing belt 614 and to widthwisely uniform tension acting on the fixing belt 614, the belt-supporting roller 615 is formed into a so-called crown shape in which a central portion thereof is made larger in outer diameter than end portions thereof by 100 μm.

Furthermore, a belt edge position detection mechanism (not shown) that detects the edge position of the fixing belt 614 is disposed in the vicinity of the belt-supporting roller 615. And, the belt-supporting roller 615, having disposed thereon an axis displacement mechanism that displaces the axial abutment position of the fixing belt 614 in response to the detection result of the belt edge position detection mechanism, is configured to control the meandering (belt walk) of the fixing belt 614.

The belt-supporting roller 618 has as its base substance a stainless pipe roller of 23 mm outer diameter, 2 mm wall thickness, and 420 mm length, the surface of which is coated with a 20 μm thick PFA to form a release layer. This release layer is formed in order that a slight amount of offset toner and paper dust from the outer surface of the fixing belt 614 is prevented from accumulating on the belt-supporting roller 618. Besides, to minimize axial displacement of the fixing belt 614 and to uniform the tension of the fixing belt 614, the belt-supporting roller 618 is formed into a so-called crown shape in which a central portion thereof is made larger in outer diameter than end portions thereof by 100 μm. Additionally, not only are both the belt-supporting roller 615 and the belt-supporting roller 618 formed into the crown shape, but any one of the belt-supporting roller 615 and the belt-supporting roller 618 may be formed into the crown shape.

A rated 800 W halogen heater 616*b* is disposed as a heating source within the belt-supporting roller 618, and the surface temperature of the belt-supporting roller 618 is controlled to 200° C. by a temperature sensor 617*c* and the control section (see FIG. 1). Accordingly, the belt-supporting roller 618 has the function of heating the fixing belt 614 from the outer surface, combined with the function of supporting the fixing belt 614. Accordingly, since the halogen heater 616 serving as a heating source is also disposed within the belt-supporting roller 615, this embodiment is configured such that the fixing belt 614 is auxiliary-heated by both the belt-supporting roller 615 and the belt-supporting roller 618.

Additionally, the belt-supporting roller 618 has even the function of serving as a tension roller that applies a tension of 10 kgf to the entire fixing belt 614.

Furthermore, the belt-supporting roller 618 has disposed thereon a cleaning web mechanism 70 for abutting the surface of the belt-supporting roller 618 to wipe off offset toner and paper dust that have adhered to the surface of the belt-supporting roller 618 from the outer surface of the fixing belt 614.

The pressure belt module 62 will subsequently be described. The pressure belt module 62 has its main portion configured of a pressure belt 620 and a pressure pad (pressure member) 63. The pressure belt 620 is stretched over three rollers: a lead roller 621, a pressure roller 65, and a belt-supporting roller 623. On the inner side of the pressure belt 620, the pressure pad 63 is disposed biased against the fixing roller 610 via the pressure belt 620. And, when the pressure belt module 62 is disposed pressed against the fixing belt module 61, as the fixing roller 610 of the fixing belt module 61 rotates in the direction of arrow A, the pressure belt 620 is driven by the fixing roller 610 to rotate in the direction of arrow B. The advance speed of the pressure belt 620 is 400 mm/s which is the same as the surface speed of the fixing roller 610.

When the pressure belt module 62 is disposed pressed against the fixing belt module 61, a nip portion N is configured in the contact portion between the pressure belt module 62 and the fixing belt module 61. The nip portion N is formed so that the pressure belt 620 is brought into pressure contact with the outer surface of the fixing belt 614, within the region where the fixing belt 614 is wrapped around the fixing roller 610 (such a region is hereinafter called a "wrap region"). In this nip portion N, the pressure pad 63 is disposed on the inner side of the pressure belt 620 in the state where it is biased toward the fixing roller 610 side via the pressure belt 620, thus pressing the pressure belt 620 against the wrap region of the fixing roller 610. Besides, the pressure roller 65 is disposed in the most downstream portion of the nip portion N. And, the pressure roller 65 is biased toward the central axis of the fixing roller 610 via the pressure belt 620 and the fixing belt 614, thus causing local high pressure in the abutment portion between the fixing roller 610 and the fixing belt 614.

The sheet P bearing the toner image is heated and pressurized when passing through this nip portion N to fix the toner image to the sheet P. On this occasion, the local high pressure applied by the pressure roller 65 in the most downstream portion of the nip portion N imparts appropriate gloss to the toner image on the sheet P. Additionally, in the fixing unit 60 of this embodiment, the nip portion N is formed as a strip-like region that extends through a central angle of 45° relative to the rotation axis of the fixing roller 610 (which central angle is hereinafter called a "wrap angle"), in which case a nip width is 26 mm.

Here, the pressure belt 620 preferably includes a base layer, a release layer coated on a surface thereof on the fixing roller 610 side or on both surfaces thereof, and further an elastic layer formed between the base layer and the release layer. And, the base layer is formed of a resin having high heat-resistant strength, for which are suitably adopted, for example, polyimide, polyamide, and polyamide-imide. The base layer is formed to have a thickness, for example, of the order of 50 to 125 μm, more preferably, of 75 to 100 μm.

Besides, the release layer is preferably coated with a fluorine resin, for example, PFA in a thickness of 5 to 20 μm. Furthermore, the elastic layer can use, for example, silicone rubber that has a thickness of 20 to 500 μm, preferably, 50 to 300 μm and a rubber hardness of 8 to 70° (JIS-A), preferably, 15 to 30° (JIS-A).

In the fixing unit 60 of this embodiment, the pressure belt 620 is configured by laminating on the outer surface side (fixing belt module 61 side) thereof an elastic layer and a release layer to a base layer. The base layer has polyimide film of 75 μm thickness, 370 mm width, and 288 mm circumference. The elastic layer is made up of silicone rubber of 30° (JIS-A) rubber hardness and 100 μm thickness. And, the release layer is made up of a 30 μm thick fluorocarbon resin (PFA).

The three rollers having the pressure belt 620 stretched thereover, which include the stainless lead roller 621, the pressure roller 65 to be described in detail later, and the stainless belt-supporting roller 623, support the pressure belt 620 at a tension of 10 kgf. The rollers 621, 65, and 623 are 25 mmϕ, 40 mmϕ, and 25 mmϕ in outer diameter, respectively, and are 390 mm in length. Besides, a halogen heater 625 is disposed as a heating source within the lead roller 621. And, a not-shown temperature sensor and the control section (see FIG. 1) control the surface temperature of the lead roller 621 to 120° C., thus preheating the pressure belt 620.

Besides, a belt edge position detection mechanism (not shown) that detects the edge position of the pressure belt 620 is disposed in the vicinity of the belt-supporting roller 623. And, the belt-supporting roller 623, having disposed thereon an axis displacement mechanism that displaces the axial abutment position of the pressure belt 620 in response to the detection result of the belt edge position detection mechanism, is configured to control the meandering (belt walk) of the pressure belt 620.

Furthermore, the pressure pad 63 serving as the press member, including an elastic member and a low-friction layer, is held on a holder (not shown) made up of metal, etc. The elastic member is for securing the nip portion N wide in width, and the low-friction layer is provided on a surface of the elastic member which is brought into contact with the inner surface of the pressure belt 620. The elastic member having the low-friction layer on the surface thereof, formed into a convex shape in which the fixing roller 610 side substantially follows the outer surface of the fixing roller 610, is disposed pressed against the fixing roller 610, thus forming an entrance side region of the nip portion N formed in the wrap region of the fixing roller 610.

The elastic member of the pressure pad 63 may be formed by use of an elastic body of high heat resistance, such as silicone rubber and fluorocarbon rubber, a leaf spring, etc. The low-friction layer formed on the elastic member is provided in order to reduce the sliding resistance between the inner surface of the pressure belt 620 and the pressure pad 63. And, the low-friction layer is desirably of abrasion-resistant material having a small friction coefficient. Specifically, a glass fiber sheet impregnated with Teflon (trademark), a fluorocarbon resin sheet, a fluorocarbon resin film, etc. can be used as the material.

Additionally, other than a pad that is molded into a pad shape as in this embodiment, for example, a pad that is molded into a roll shape can be used as the pressure pad 63 and may be driven to rotate by being biased against the surface of the fixing roller 610 via the pressure belt 620. However, the pressure pad 63, which is molded into a pad shape as in this embodiment, can more widely and uniformly apply nip pressure over the entire area of the nip portion N abutted thereby.

The pressure roller 65 disposed downstream of the pressure pad 63 in the direction of transport of the sheet P (the direction of arrow C) is biased toward the central axis of the fixing roller 610 via the pressure belt 620 and the fixing belt 614, thus causing local high pressure in the abutment portion between the fixing roller 610 and the fixing belt 614. On this occasion, to efficiently apply this local high pressure to the fixing roller 610 and the fixing belt 614 under a low load, the pressure roller 65 is desirably formed to have a smaller outer diameter than the fixing roller 610 and to have a harder surface than the surface of the fixing roller 610.

The fixing operation of the fixing unit 60 of this embodiment will now be described.

The sheet P having the unfixed toner images electrostatically transferred thereto in the secondary transfer section (see FIG. 1) of the image forming apparatus is transported toward the nip portion N of the fixing unit (in the direction of arrow C) by the transport belt 55 and the fixing entrance guide 56. The pressure belt module 62 is disposed pressed against the fixing belt module 61 during the image forming operation, and the unfixed toner images on the surface of the sheet P passing through the nip portion N are fixed to the sheet P by pressure and heat acting on the nip portion N. As aforesaid, the fixing unit 60 of this embodiment is configured such that the fixing roller 610 having the fixing belt 614 wrapped therearound and the pressure belt 620 are abutted against each other while the pressure pad 63 is being pressed thereagainst. With such a configuration, the nip portion N can be set wide, thus making it possible to secure stable fixing performance.

On this occasion, in the fixing unit 60 of this embodiment, heat acting on the nip portion N is supplied mainly by the fixing belt 614. The fixing belt 614 is configured to be heated by: the heat supplied through the fixing roller 610 from the halogen heater 613 disposed within the fixing roller 610; the heat supplied through the belt-supporting roller 615 from the halogen heater 616*a* disposed within the belt-supporting roller 615; and the heat supplied through the belt-supporting roller 618 from the halogen heater 616*b* disposed within the belt-supporting roller 618. Consequently, even when heat energy is not sufficient from only the fixing roller 610, the heat energy can be properly and rapidly replenished from the belt-supporting roller 615 and the belt-supporting roller 618. Therefore, in the nip portion N, a sufficient amount of heat can be secured even at a high process speed of 400 mm/s.

That is, in the fixing unit 60 of this embodiment, the fixing belt 614 that functions as a direct heating member can be formed to have an extremely low heat capacity. In addition, the fixing belt 614 is configured to make contact with the fixing roller 610 serving as a heat supply member and the belt-supporting rollers 615 and 618 in a wide wrap area (at a large wrap angle). Consequently, the fixing belt 614, during a short period of its rotation through one revolution, is supplied with a sufficient amount of heat from the fixing roller 610, belt-supporting roller 615, and belt-supporting roller 618. Therefore, this makes it possible to restore the temperature of the fixing belt 614 to a necessary fixing temperature in a short time. Accordingly, in the nip portion N, a predetermined fixing temperature can be always maintained even when the fixing unit 60 is increased in speed.

As a result thereof, the fixing unit 60 of this embodiment makes it possible to restrain the occurrence of a temperature droop phenomenon in which the fixing temperature decreases during the start of a high-speed fixing operation. Particularly, temperature droop can be restrained from occurring even in the fixing to thick paper, etc. having a high heat capacity. Furthermore, even when the fixing temperature need be switched in response to the kind of paper in the middle of the operation (which includes an increase and a reduction in fixing temperature), since the fixing belt 614 has a low heat capacity, the power adjustment of the halogen heaters 613 and further the halogen heaters 616*a* and 616*b* makes it possible to easily and rapidly switch to a desirable temperature.

Besides, the fixing unit 60 of this embodiment is configured such that, in the nip portion N, the pressure belt 620 of the pressure belt module 62 abuts the outer surface of the fixing belt 614 only in the region (wrap region) where the fixing belt 614 is wrapped around the surface of the fixing roller 610. That is, the fixing roller 610 is positioned over the entire area of the nip portion N on the inner surface side of the fixing belt 614. Accordingly, the fixing belt 614 and the pressure belt 620 are abutted against each other in the state where they are stably supported by the surface of the fixing roller 610. Therefore, both the belts 614 and 620 can be brought into uniform and close contact with each other in the entire area of the nip portion N. Such a satisfactory close contact between the fixing belt 614 and the pressure belt 620 makes it possible to efficiently conduct heat from the fixing belt 614 to the sheet P, so that temperature droop can be effectively retrained from occurring.

Furthermore, with such a configuration of the nip portion N, the region in which the fixing belt 614 makes contact with only the fixing roller 610 is formed in an upstream portion of the fixing belt 614 on the entrance side of the nip portion N. Consequently, a cockle caused in the fixing belt 614 during its rotation is corrected when the fixing belt 614 passes through this region. Accordingly, in the nip portion N, the fixing belt 614 can make smooth contact with the unfixed toner images on the sheet P, so that a good-quality fixed image can be obtained.

In addition, in the fixing unit 60 of this embodiment, the pressure roller 65, which is disposed biased toward the central axis of the fixing roller 610, is disposed in the most downstream portion of the nip portion N. And, the pressure roller 65 applies local high pressure to a fused toner image. Thereby, high fixability is secured, the surface of the toner image is smoothed, and particularly satisfactory image gloss is imparted to a color image. As aforesaid, the pressure roller 65 is formed to have a smaller diameter than the fixing roller 610 and to have a harder surface than the surface of the fixing roller 610. Thereby, local high pressure can be efficiently applied to the toner image under a low load.

A description will now be given of the pressure roller 65 that is disposed biased toward the central axis of the fixing roller 610 in the most downstream portion of the nip portion N.

Figure 3:
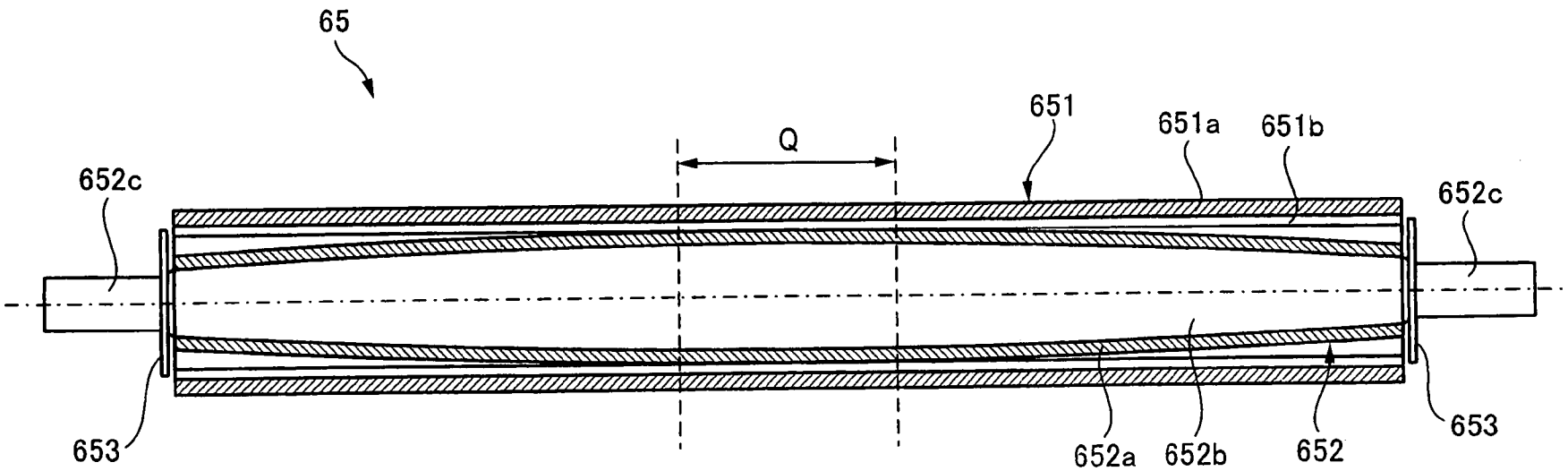
FIG. 3 is a sectional side view showing a configuration of a pressure roller.

The configuration of the pressure roller 65 will first be described. FIG. 3 is a sectional side view showing the configuration of the pressure roller 65. As shown in FIG. 3, the pressure roller 65 includes an outer roller (first roller) 651 disposed outside and an inner roller (second roller) 652 disposed inside the outer roller 651. That is, the pressure roller 65 is configured into a double roller structure (roller-in-roller structure) by the outer roller 651 and the inner roller 652. The outer roller 651 supports the pressure belt 620 and presses the fixing roller 610. And, the inner roller 652 is disposed, inside the outer roller 651, coaxially with the outer roller 651 in the state where the pressure roller 65 is not in pressure contact with the fixing roller 610.

Here, the outer roller 651, using an aluminum pipe (hollow cylindrical body) as a base material 651*b*, is a cylindrical roller member having an elastic layer 651*a* coated on the outer surface of the base material 651*b*. Besides, the inner roller 652, using a stainless, substantially cylindrical body (solid) as a base material 652*b*, is a substantially cylindrical roller member having an elastic layer 652*a* coated on the outer surface of the base material 652*b*. And, the base material 652*b* of the inner roller 652 is formed into a so-called crown shape (crown profile) in which an axially central portion thereof is larger in outer diameter than both end portions thereof. In the fixing unit 60 of this embodiment, the outer roller 651 has the elastic layer 651*a* of silicone rubber having a hardness of 35° (JIS-A) and a thickness of 5 mm coated on the base material 651*a* of aluminum pipe having an outer diameter of 40 mm, an inner diameter of 33 mm, and a length of 390 mm. Besides, the inner roller 652 has the elastic layer 652*a* of EPDM rubber having a hardness of 50° (JIS-A) and a thickness of 2.75 mm coated on the base material 652*b* of stainless solid shaft formed into the crown profile in which the central portion has an outer diameter of 27.5 mm and the both end portions have an outer diameter of 26 mm.

The inner roller 652 has support portions 652*c* provided in both axially outside end portions of a region thereof in which the outer roller 651 is disposed. And, the support portions 652*c* provided on the inner roller 652 are pressed toward the fixing roller 610 by spring members (not shown) such as springs while being rotatably supported on a body frame (not shown) of the fixing unit 60. Thereby, when the pressure belt module 62 is disposed pressed against the fixing belt module 61, the inner roller 652 presses the outer roller 651 against the fixing roller 610 via the fixing belt 614 and the pressure belt 620. Besides, during the fixing operation, the outer roller 651 and the inner roller 652 are driven by the rotation of the fixing roller 610 to rotate in an integrated manner.

The support portions 652*c* provided in the both end portions have position restriction plates 653 disposed in proximity to both end side portions of the outer roller 651. And, the position restriction plates 631 restrict the outer roll 651 from moving axially beyond a predetermined range.

A description will now be given of the function of the outer roller 651 and inner roller 652 when the pressure roller 65 is pressed to the fixing roller 61 side.

Figure 4:
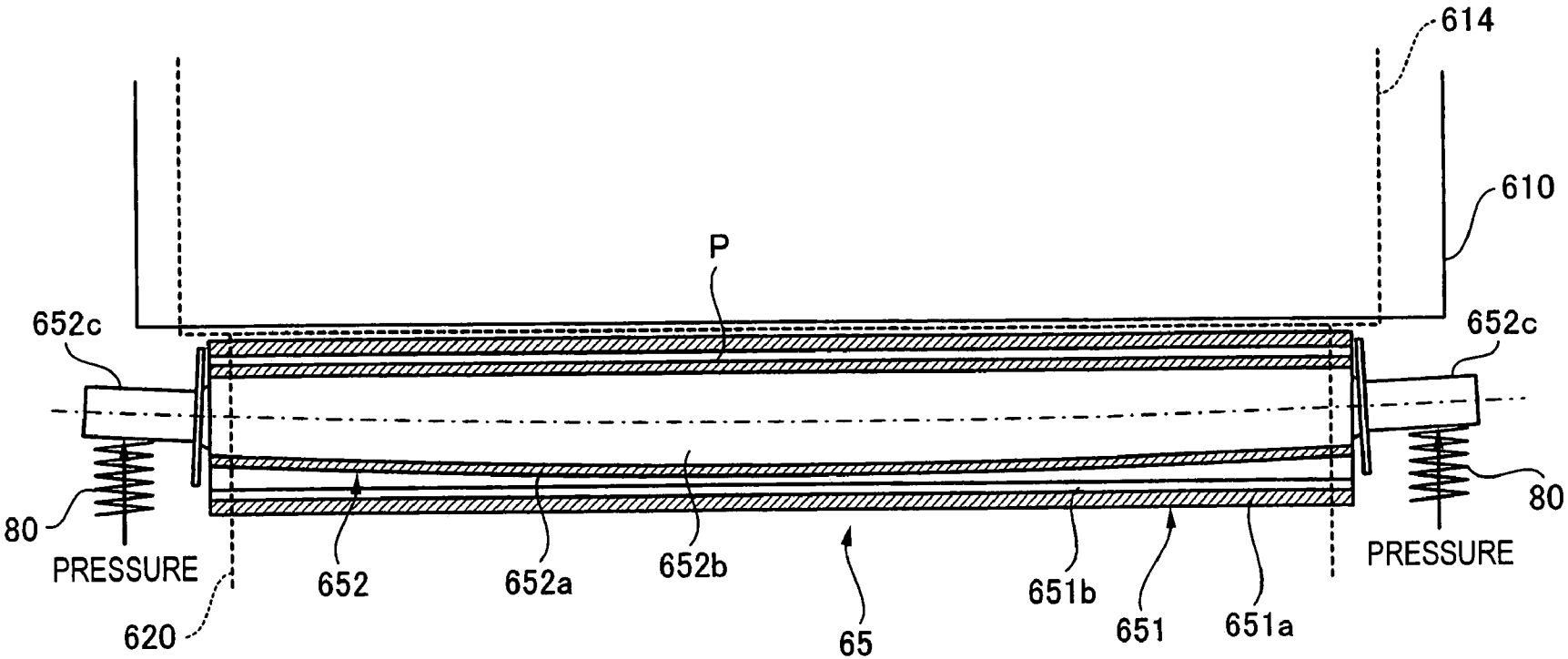
FIG. 4 is a view showing a state in which the pressure roller is pressed to the side of a fixing roller.

FIG. 4 is a view showing the state in which the pressure roller 65 is pressed to the fixing roller 61 side when the pressure belt module 62 is disposed pressed against the fixing belt module 61. As shown in FIG. 4, when the support portions 652*c* provided in the both axially outside end portions of the inner roller 652 are pressed to the fixing roller 610 side by the spring member 80, then in the entire inner roller 652, there occurs arcuate deflection in which the central portion of the inner roller 652 sags toward the fixing roller 610 side. However, the inner roller 652 has the base material 652*b* formed, as aforesaid, in the crown shape in which the axially central portion has a larger outer diameter than the both end portions. Consequently, even when the deflection occurs in the inner roller 652, the sag of the axially central portion will be balanced out by the crown shape of the inner roller 652 itself. Thereby, in a surface region P where the inner roller 652 presses the outer roller 651 from inside, the outer surface of the inner roller 652 is shaped to substantially follow the inner surface of the outer roller 651 which has an axially flat surface shape. As a result, this makes it possible, in the surface region P pressing the outer roller 651, that the inner roller 652 presses the outer roller 651 by substantially uniform force throughout the axial direction.

Consequently, even when the pressure roller 65 is pressed to the fixing roller 610 side, deflection hardly occurs in the outer roller 651. This makes it possible, in the abutment surface between the pressure roller 65 and the fixing roller 610 via the fixing belt 614 and the pressure belt 620 (the surface corresponding to a surface region P where the inner roller 652 presses the outer roller 651), that the pressure roller 65 makes pressure contact with the fixing roller 610 by axially substantially uniform force. Therefore, in the most downstream portion of the nip portion N, axially substantially uniform local pressure can be applied to the toner image on the sheet P. As a result thereof, the toner image passed through the nip portion N can obtain high fixability which is uniform widthwise of the sheet P. Besides, particularly, the surface of the toner image before solidified can be widthwisely uniformly smoothed, thus making it possible even to impart uniform and appropriate gloss to the toner image.

In the meantime, when the fixing roller 610 receives pressure from the pressure roller 65, a reaction force against the pressure from the pressure roller 65 occurs in the fixing roller 610. Therefore, even in the fixing roller 610, there sometimes occurs arcuate deflection in which the central portion of the fixing roller 610 sags toward the pressure roller 65 side. In this case, the fixing roller 610 is configured to have higher rigidity than the pressure roller 65, so that the amount of deflection of the fixing roller 610 is extremely small as compared with the inner roller 652. Consequently, even when the fixing roller 610 deflects when pressed by the pressure roller 65, as aforesaid, the inner roller 652 presses the outer roller 651 by axially substantially uniform force in the surface region P pressing the outer roller 651. Therefore, in the surface where the outer roller 651 and the fixing roller 610 are pressed, the outer shape of the outer roller 651 can deform following slight deflection of the fixing roller 610. In addition, even in this state, the inner roller 652 presses the outer roller 651 by axially substantially uniform force. Therefore, even when slight deflection occurs in the fixing roller 610, the pressure roller 65 can make pressure contact with the fixing roller 610 by axially substantially uniform pressure.

Additionally, in the pressure roller 65 of this embodiment, the base material 652*b* of the inner roller 652 is formed into the crown profile, thereby forming the entire inner roller 652 into the crown profile. However, it is also possible that the base material 652*b* is formed of a straight solid shaft, and the elastic layer 652*a* coated on the base material 652*b* is formed into the crown profile, thereby forming the entire inner roller 652 into the crown profile. That is, the pressure roller 65 can adopt any configuration which can form the entire inner roller 652 into the crown profile.

Next, the pressure roller 65 of this embodiment is formed such that, in the state where the pressure roller 65 is out of pressure contact with fixing roller 610, the outer roller 651 and the inner roller 652 are disposed coaxially with each other, and such that, in the axially central portion (region Q in FIG. 3), the outer surface of the inner roller 652 makes contact with the inner surface of the outer roller 651. That is, the pressure roller 65 is formed such that an outer diameter of the inner roller 652 in the axially central portion thereof is substantially equal to, on the order of slightly larger than, the inner diameter of the outer roller 651. Thus, the configuration is such that, in the state where the pressure roller 65 is out of pressure contact with fixing roller 610, the axially central portion of the inner roller 652 is brought into contact with the inner surface of the outer roller 651 by elastic compression of the elastic layer 652*a* of the inner roller 652, so that the outer roller 651 is supported by the inner roller 652.

In the meantime, in the fixing unit 60 of this embodiment, the fixing belt module 61 and the pressure belt module 62 are configured capable of being in and out of contact with each other. That is, during the image forming operation, as shown in FIG. 2, the fixing belt module 61 and the pressure belt module 62 are disposed in pressure contact with each other in the nip portion N. However, in order for the image forming apparatus to start the image forming operation upon reception of an image forming operation directing signal, the fixing unit 60 need be preset to the state in which the temperature of the fixing belt 614 is increased up to a predetermined value so as to enable a fixing process for a short period of time. Besides, similarly, the pressure belt 620 also need be preheated up to a predetermined temperature so as not to unnecessarily draw heat from the fixing belt 614 to reduce the temperature of the fixing belt 614 during the fixing operation. In this case, the fixing belt module 61 and the pressure belt module 62 are set to be out of contact with each other (in a retracted state), wherein the fixing belt module 61 and the pressure belt module 62 heat the fixing belt 614 and the pressure belt 620, respectively, while performing their separate rotation operations.

Accordingly, in this case, even the pressure belt module 62, as being retracted from the fixing belt module 61, rotates the pressure belt 620 by stretching it over the lead roller 621, pressure roller 65, and belt-supporting roller 623. And, the pressure belt 620 is heated uniformly circumferentially thereof by the halogen heater 625 disposed in the head roller 621.

When the pressure belt module 62 thus rotates being retracted from the fixing belt module 61, the pressure roller 65 rotates out of pressure contact with the fixing roller 610 side. Consequently, in the pressure roller 65, when the outer roller 651 is unstably supported on the inner roller 652, a large axial oscillation occurs in the outer roller 651 during the rotation of the pressure belt module 62. As a result, this makes it difficult to stably rotate the pressure belt 620 even when the axis displacement mechanism for controlling the belt walk is disposed on the belt-supporting roller 623. Consequently, the following situation can be assumed. Consequently, a large belt walk occurs in the pressure belt 620, so that end portions of the pressure belt 620 strongly hit members such as the body frame, thereby causing cracks in the end portions of the pressure belt 620 and eventually damaging the entire pressure belt 620.

In contrast, the pressure roller 65 for use in the pressure belt module 62 of this embodiment is configured as follows. That is, in the state where the pressure roller 65 is out of pressure contact with the fixing roller 610, the outer roller 651 and the inner roller 652 are disposed coaxially with each other, and the outer surface of the inner roller 652 in the axially central portion thereof makes contact with the inner surface of the outer roller 651. Consequently, in the state where the pressure roller 65 is out of pressure contact with the fixing roller 610, the outer roller 651 and the inner roller 652 are disposed coaxially with each other, and the outer roller 651 is stably supported by the axially central portion in which it makes contact with the inner roller 652. Therefore, this makes it possible to minimize the axial oscillation occurring in the outer roller 651. Thereby, when the pressure belt module 62 rotates being retracted from the fixing belt module 61, the belt walk of the pressure belt 620 resulting from the oscillation of the outer roller 651 can be sufficiently controlled by the axis displacement mechanism disposed on the belt-supporting roller 623. Thus, the pressure belt 620 can be stably rotated.

Consequently, this makes it possible to uniformly heat the pressure belt 620 in the state where the pressure belt module 62 is retracted from the fixing belt module 61, while avoiding the situation in which cracks occur in the end portions of the pressure belt 620 and the entire pressure belt 620 is eventually damaged.

Here, in the state where the pressure roller 65, which is formed such that the outer diameter of the inner roller 652 and the inner diameter of the outer roller 651 are formed to be substantially equal to each other, is out of pressure contact with the fixing roller 610, the following condition is preferable to stably suppress the oscillation of the outer roller 651. The condition is that a region in which the outer surface of the inner roller 652 and the inner surface of the outer roller 651 make contact with each other (contact region: the vicinity of the region Q shown in FIG. 3) should be in a length region of 1/10 to 1/5 of the axial length of the outer roller 651. That is, it is undesirable that the contact region Q is smaller than 1/10 of the axial length of the outer roller 651. This is because, in this case, the support of the outer roller 651 by the inner roller 652 is destabilized to cause a comparatively increasing trend of the oscillation of the outer roller 651, so that the oscillation sometimes cannot be suppressed by the belt walk control of the axis displacement mechanism disposed on the belt-supporting roller 651. Besides, it is undesirable that the contact region is larger than 1/5 of the axial length of the outer roller 651. This is because, in this case, the above-described deflection of the inner roller 652, which is caused when the pressure roller 65 is pressed to the fixing roller 610 side, is insufficiently compensated with the crown profile of the inner roller 652, which therefore reduces the effect of bringing the pressure roller 65 into pressure contact with the fixing roller 610 by axially substantially uniform pressure. Accordingly, the pressure roller 65 is preferably configured such that the outer surface of the inner roller 652 and the inner surface of the outer roller 651 make contact with each other, over the region of 1/10 to 1/5 of the axial length of the outer roller 651, in axial symmetry about the axial center of the outer roller 651.

Figure 5:
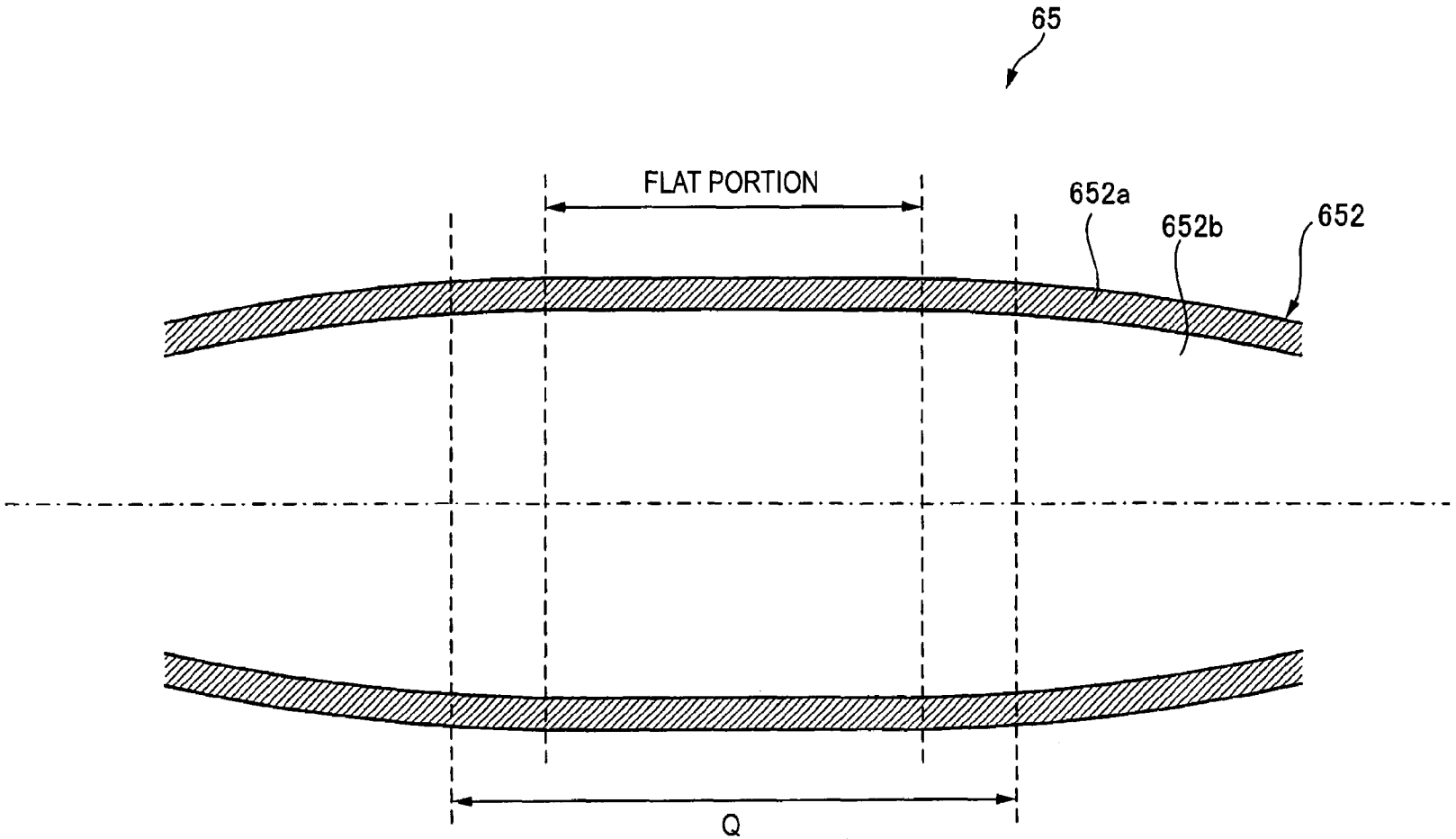
FIG. 5 is a partial sectional side view showing an example of a configuration of an inner roller.

Additionally, as shown in FIG. 5, the axially central portion (region Q in FIG. 3) may be configured such that a flat portion formed to have a constant outer diameter is formed on the outer surface of the inner roller 652, and such that the outer surface of the inner roller 652 and the inner surface of the outer roller 651 make contact with each other in a region including this flat portion. Such a configuration makes it possible even to more stably support the inner roller 652 and the outer roller 651 in the flat portion.

Figure 6:
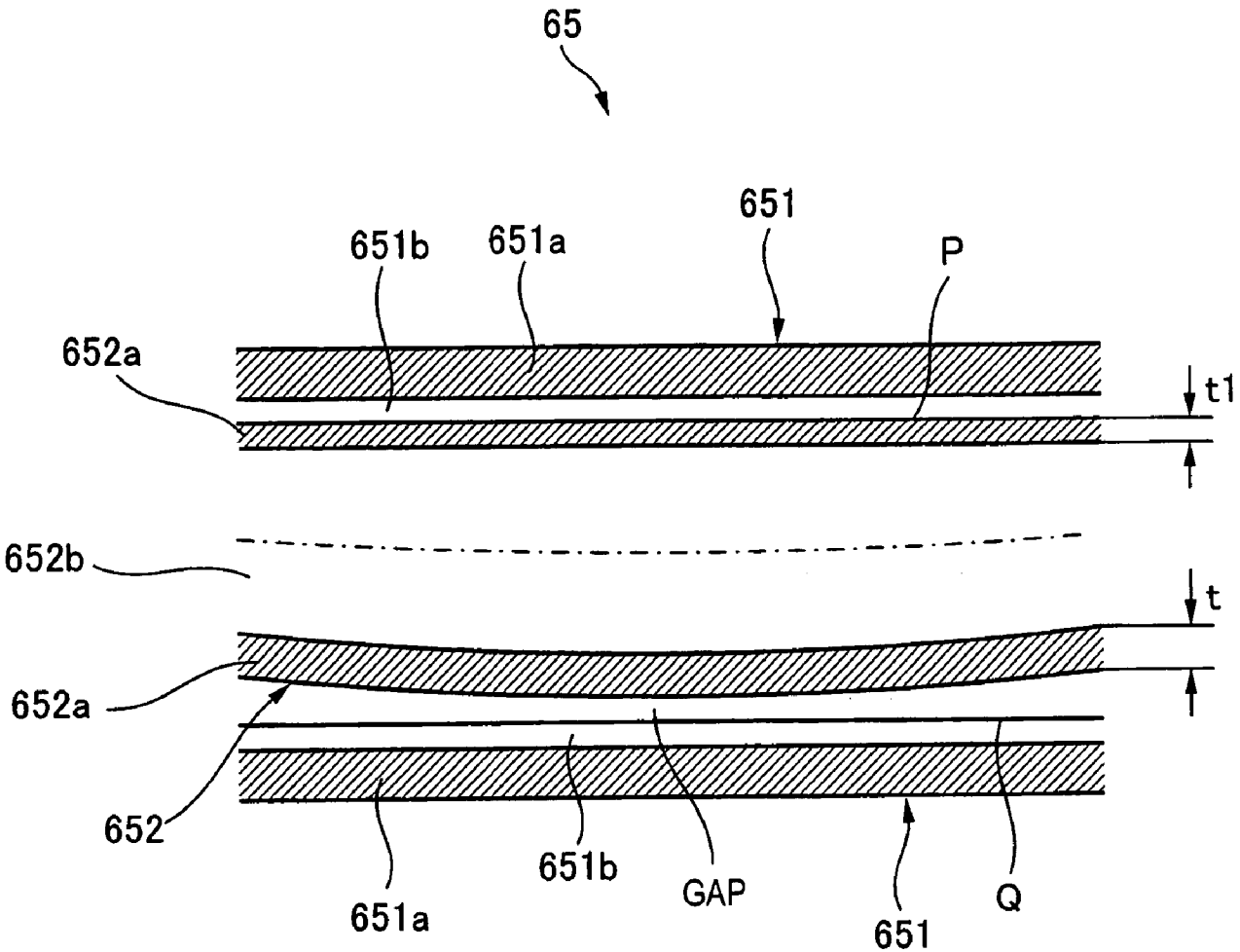
FIG. 6 is a partial sectional side view showing an axially central portion of the pressure roller in a state where the pressure roller is in pressure contact with the fixing roller.

The elastic layer 652*a* coated on the inner roller 652 of the pressure roller 65 will subsequently be described. FIG. 6 is a partial sectional side view showing the axially central portion of the pressure roller 65 in the state where the pressure roller 65 is in pressure contact with the fixing roller 610. That is, FIG. 6 represents the periphery of a region of the pressure roller 65 in which the outer diameter of the inner roller 652 is configured to be the largest when the pressure roller 65 is brought into pressure contact with the fixing roller 610.

As shown in FIG. 6, when the pressure roller 65 is brought into pressure contact with the fixing roller 610, it follows that the entire inner roller 652 deflects in an arcuate form in which the central portion thereof sags towards the fixing roller 610 side. However, since the inner roller 652 has the base material 652*b* formed in the crown shape as aforesaid, the sag of the axially central portion due to the deflection is balanced out by the crown shape. Thereby, in the surface region P where the inner roller 652 presses the outer roller 651 from inside, the outer surface of the inner roller 652 is shaped to substantially follow the inner surface of the outer roller 651 which has an axially flat surface shape. Consequently, in the surface region P where the inner roller 652 presses the outer roller 651, the inner roller 652 presses the outer roller 651 by axially substantially uniform force. And, in the surface region P where the inner roller 652 presses the outer roller 651, the elastic layer 652*a* of the inner roller 652 is compressed by the pressure from the inner roller 652, which therefore reduces the thickness of the elastic layer 652*a* to a thickness t1 which is smaller than the original thickness t (t1<t).

Thereupon, in the pressure roller 65 of this embodiment, the thickness t and elastic modulus of the elastic layer 652*a* of the inner roller 652 are set such that, when the elastic layer 652*a* is compressed in the surface region P where the inner roller 652 presses the outer roller 651, in the surface region Q opposite the surface region P, a gap occurs between the outer surface of the inner roller 652 and the inner surface of the outer roller 651.

This is on the basis that, since the elastic layer 652*a* of the inner roller 652 is compressed in the surface region P where the inner roller presses the outer roller 651, there occurs the phenomenon in which the surface speed of the inner roller 652 is different between the surface region P in which the elastic layer 652*a* is compressed and the surface region Q in which the elastic layer 652*a* is not compressed. That is, according to the characteristic which the elastic layer 652*a* disposed on the surface of the inner roller 652 has as an elastic body, the surface speed of the elastic layer 652*a* which is compressed in the surface region P is increased, while the surface speed of the elastic layer 652*a* which is not compressed in the surface region Q is reduced. Consequently, the surface speed of the outer roller 651 rotating in accordance with the surface speed of the elastic layer 652*a* in the surface region P is made slower than the surface speed of the inner roller 652, in the surface region Q where the elastic layer 652*a* is not compressed. As a result thereof, in the surface region Q, a difference occurs between the surface speed of the outer surface of the inner roller 652 and the surface speed of the inner surface of the outer roller 651.

Consequently, in the state where the pressure roller 65 is in pressure contact with the fixing roller 610, when the outer surface of the inner roller 652 and the inner surface of the outer roller 651 are configured to abut each other, it follows that the outer surface of the inner roller 652 and the inner surface of the outer roller 651 are brought into friction with each other. And, this causes an abnormal noise between the inner roller 652 and the outer roller 651 and a scratch on the elastic layer 652*a* of the inner roller 652, so that there arises the possibility in which a predetermined crown profile of the inner roller 652 cannot be maintained.

Thereupon, the pressure roller 65 of this embodiment, the thickness t and elastic modulus of the elastic layer 652*a* of the inner roller 652 is set such that, when the elastic layer 652*a* is compressed in the surface region P where the inner roller 652 presses the outer roller 651, in the surface region Q, a gap occurs between the outer surface of the inner roller 652 and the inner surface of the outer roller 651. Thereby, even when in the surface region Q a difference in surface speed occurs between the outer surface of the inner roller 652 and the inner surface of the outer roller 651, friction can be prevented from occurring therebetween. Therefore, the abnormal noise is restrained from occurring, and the scratch is prevented from occurring on the elastic layer 652*a* of the inner roller 652, thus making is possible even to maintain the predetermined crown profile of the inner roller 652.

As described above, in the fixing unit 60 of this embodiment, the pressure roller 65 that presses the fixing roller 610 in the most downstream portion of the nip portion N is configured in the double roller structure (roller-in-roller structure) by the outer roller 651 disposed outside and the inner roller 652 that is disposed inside the outer roller 651 and also formed in the crown shape. And, the configuration is such that the inner roller 652 is pressed from the both axially outside end portions to thereby press the entire pressure roller 65 to the fixing roller 610 side. With such a configuration, the inner roller 652, which presses the entire pressure roller 65 to the fixing roller 610 side, deflects, but such deflection is balanced out by the crown shape of the inner roller 652 itself, and thereby the inner roller 652 can press the outer roller 651 by axially substantially uniform pressure. This makes it possible to bring the pressure roller 65 into pressure contact with the fixing roller 610 by axially substantially uniform pressure. Consequently, in the most downstream portion of the nip portion N, axially substantially uniform local pressure can be applied to the toner image on the sheet P. As a result thereof, the toner image passed through the nip portion N can obtain high fixability which is uniform widthwise of the sheet P. Besides, particularly, the surface of the toner image before solidified can be widthwisely uniformly smoothed, thus making it possible even to impart uniform and appropriate gloss to the toner image.

In the fixing unit 60 of this embodiment, the pressure roller 65 is configured as follows. That is, in the state where the pressure roller 65 is out of pressure contact with the fixing roller 610, the outer roller 651 and the inner roller 652 are disposed coaxially with each other, and the outer surface of the inner roller 652 in the axially central portion thereof makes contact with the inner surface of the outer roller 651. Consequently, even in the state where the pressure roller 65 is out of pressure contact with the fixing roller 610, the outer roller 651 is stably supported by the axially central portion in which it makes contact with the inner roller 652. This makes it possible to minimize the axial oscillation occurring in the outer roller 651. Therefore, when the pressure belt module 62 rotates being retracted from the fixing belt module 61, the belt walk of the pressure belt 620 resulting from the oscillation of the outer roller 651 can be sufficiently controlled to make it possible to stably rotate the pressure belt 620. As a result, this makes it possible to uniformly heat the pressure belt 620 with the pressure belt module 62 placed in the retracted state, while avoiding the situation in which cracks occur in the end portions of the pressure belt 620 and the entire pressure belt 620 is eventually damaged.

Furthermore, in the fixing unit 60 of this embodiment, the pressure roller 65 has the thickness t and elastic modulus of the elastic layer 652*a* of the inner roller 652 set such that, when the elastic layer 652*a* is compressed in the surface region P where the inner roller 652 presses the outer roller 651, in the surface region Q opposite the surface region P, a gap occurs between the outer surface of the inner roller 652 and the inner surface of the outer roller 651. Thereby, even when in the surface region Q a difference in surface speed occurs between the outer surface of the inner roller 652 and the inner surface of the outer roller 651, friction does not occur therebetween.

Therefore, the abnormal noise is restrained from occurring, and the scratch is also prevented from occurring on the elastic layer 652*a* of the inner roller 652, thus making is possible even to maintain the predetermined crown profile of the inner roller 652.

In addition, the fixing unit 60 of this embodiment adopts a configuration such that the belt-supporting roller 615 having the halogen heater 616*a* disposed is therewithin and the belt-supporting roller 618 having the halogen heater 616*b* disposed therewithin are disposed in parallel with the fixing roller 610, and such that the endless fixing belt 614 is stretched over the belt-supporting roller 615, belt-supporting roller 618, and fixing roller 610. And, the fixing belt 614 is made to function as a main heating member that heats the sheet P, and the fixing roller 610, belt-supporting roller 615, and belt-supporting roller 618 are made to function as heat supply members that supply heat to the fixing belt 614. Consequently, in the nip portion N, the predetermined fixing temperature can be always maintained even when the fixing unit 60 is increased in speed, thus making it possible to restrain temperature droop from occurring.

Second Embodiment

Figure 7:
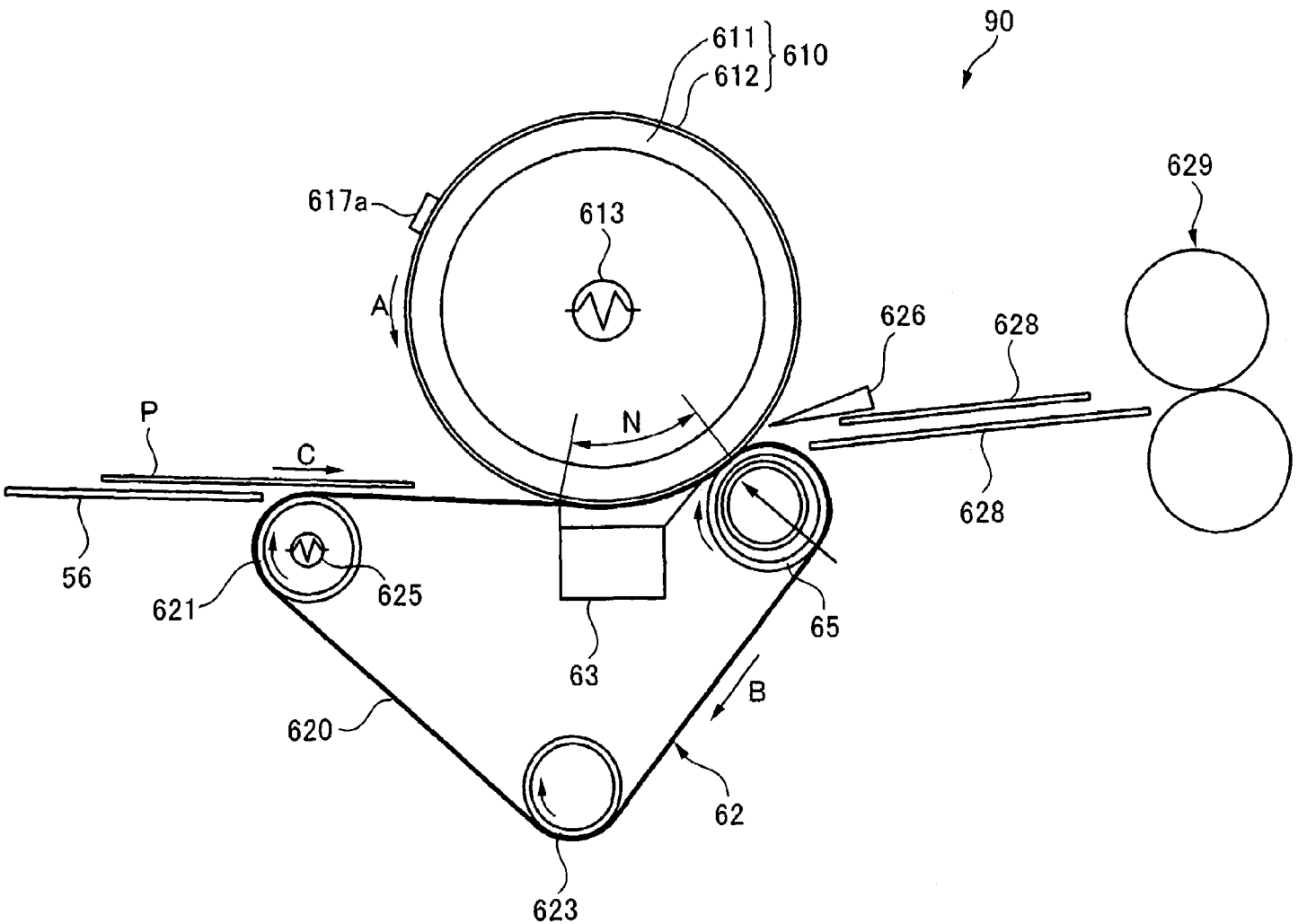
FIG. 7 is a sectional side view showing a configuration of a fixing unit according to a second embodiment.

The first embodiment has described the image forming apparatus mounted with the fixing unit 60 and the configuration thereof using, as the heating means for use in the fixing unit, the fixing belt module 61 in which the endless fixing belt 614 is stretched over the belt-supporting rollers 615 and 618 serving as the auxiliary heating members and the fixing roller 610. A second embodiment will describe a fixing unit 90 which is a fixing unit mounted on the image forming apparatus shown in FIG. 1 and in which only the fixing roller 610 is disposed as the heating means for use in the fixing unit 60. Additionally, reference numerals are used to identify the same components as those of first embodiment, and the detailed description thereof is omitted herein. FIG. 7 is a sectional side view showing the configuration of the fixing unit 90 according to this embodiment. The fixing unit 90 of this embodiment is the same as the fixing unit 60 of first embodiment except that they are different from each other in that only the fixing roller 610 is disposed in place of the fixing belt module 61 of first embodiment.

In the fixing unit 90 of this embodiment as well, the pressure roller 65 that presses the fixing roller 610 in the most downstream portion of the nip portion N is configured in the double roller structure (roller-in-roller structure) by the outer roller 651 disposed outside and the inner roller 652 that is disposed inside the outer roller 651 and also formed in the crown shape. And, the configuration is such that the inner roller 652 is pressed from the both axially outside end portions to thereby press the entire pressure roller 65 to the fixing roller 610 side. With such a configuration, the inner roller 652, which presses the entire pressure roller 65 to the fixing roller 610 side, deflects, but such deflection is balanced out by the crown shape of the inner roller 652 itself, and thereby the inner roller 652 can press the outer roller 651 by axially substantially uniform pressure. This makes it possible to bring the pressure roller 65 into pressure contact with the fixing roller 610 by axially substantially uniform pressure. Consequently, in the most downstream portion of the nip portion N, axially substantially uniform local pressure can be applied to the toner image on the sheet P. As a result thereof, the toner image passed through the nip portion N can obtain high fixability which is uniform widthwise of the sheet P. Besides, particularly, the surface of the toner image before solidified can be widthwisely uniformly smoothed, thus making it possible even to impart uniform and appropriate gloss to the toner image.

In the fixing unit 90 of this embodiment, the pressure roller 65 is configured as follows. That is, in the state where the pressure roller 65 is out of pressure contact with the fixing roller 610, the outer roller 651 and the inner roller 652 are disposed coaxially with each other, and the outer surface of the inner roller 652 in the axially central portion thereof makes contact with the inner surface of the outer roller 651. Consequently, even in the state where the pressure roller 65 is out of pressure contact with the fixing roller 610, the outer roller 651 is stably supported by the axially central portion in which it makes contact with the inner roller 652. This makes it possible to minimize the axial oscillation occurring in the outer roller 651. Therefore, when the pressure belt module 62 rotates being retracted from the fixing roller 610, the belt walk of the pressure belt 620 resulting from the oscillation of the outer roller 651 can be sufficiently controlled to make it possible to stably rotate the pressure belt 620. As a result, this makes it possible to uniformly heat the pressure belt 620 with the pressure belt module 62 placed in the retracted state, while avoiding the situation in which cracks occur in the end portions of the pressure belt 620 and the entire pressure belt 620 is eventually damaged.

Furthermore, in the fixing unit 90 of this embodiment, the pressure roller 65 has the thickness t and elastic modulus of the elastic layer 652*a* of the inner roller 652 set such that, when the elastic layer 652*a* is compressed in the surface region P where the inner roller 652 presses the outer roller 651, in the surface region Q opposite the surface region P, a gap occurs between the outer surface of the inner roller 652 and the inner surface of the outer roller 651. Thereby, even when in the surface region Q a difference in surface speed occurs between the outer surface of the inner roller 652 and the inner surface of the outer roller 651, friction does not occur therebetween. Therefore, the abnormal noise is restrained from occurring, and the scratch is also prevented from occurring on the elastic layer 652*a* of the inner roller 652, thus making is possible even to maintain the predetermined crown profile of the inner roller 652.

As described in detail with reference to the embodiments, the pressure member is capable of pressing the fixing member by axially substantially uniform pressure, thus making it possible to form a high-quality fixed image having high fixability and uniform gloss.

As described so far, according to an aspect of the invention, fixing unit that fixes a toner image carried on a recording medium includes a rotation member and a pressure belt module that is provided with a pressure belt, a pressure roller supporting the pressure belt and pressing the rotation member, and a belt-supporting roller supporting the pressure belt. The pressure roller includes a first roller that is formed into a cylindrical shape, and a second roller that is disposed inside the first roller and formed into a crown shape, in which an axially central portion thereof is larger in outer diameter than both end portions thereof.

In the fixing unit, an outer diameter of the second roller in the axially central portion may be configured to be substantially equal to an inner diameter of the first roller.

The second roller may be provided with an elastic layer coated thereon.

The pressure belt module may be configured to be capable of being in and out of contact with the rotation member.

When the pressure belt module is disposed to be out of contact with the rotation member, an inner surface of the first roller and an outer surface of the second roller may contact with each other in the axially central portion over an entire circumferential direction.

A length in the axial direction of the contact area between the inner surface of the first roller and the outer surface of the second roller may be 1/10 to 1/5 of an axial length of the first roller.

When the pressure belt module is disposed in pressure contact with the rotation member, deflection of the second roller may bring the inner surface of the first roller into contact with the outer surface of the second roller over substantially an entire axial direction on the rotation member side.

According to another aspect of the invention, a fixing unit that fixes a toner image carried on a recording medium includes a rotation member, a pressure roller that is disposed to be switchable between in a pressure contact state and in an out-of-contact state with the rotation member, and a pressure belt that is supported by the pressure roller and forms a nip portion with the rotation member. The pressure roller includes an outer roller supporting the pressure belt and an inner roller that is disposed inside the outer roller and presses the outer roller toward the rotation member.

The inner roller may be formed into a crown shape in which an axially central portion thereof is larger in outer diameter than both end portions thereof, the outer diameter of the axially central portion being substantially equal to an inner diameter of the outer roller.

The inner roller may includes a solid roller formed into a crown shape, in which an axially central portion thereof is larger in outer diameter than both end portions thereof, and an elastic layer coated in uniform thickness on the solid roller.

The inner roller may have a flat portion formed in the axially central portion.

When the pressure roller is disposed in the out-of-contact state, an inner surface of the outer roller and an outer surface of the inner roller may contact with each other in the axially central portion over an entire circumferential direction, and when the pressure roller is disposed in the pressure contact state, deflection of the inner roller may bring the inner surface of the outer roller into contact with the outer surface of the inner roller over substantially an entire axial direction on the rotation member side.

The rotation member may include a fixing roller that is rotatably provided, a fixing belt that is supported and rotated by the fixing roller, and a belt-supporting roller that supports the fixing belt.

The outer roller may be provided with an elastic layer formed thereon.

According to another aspect of the invention, a roller member which is used in a fixing unit and pressable against a rotation member provided in the fixing unit includes a first roller that is formed into a cylindrical shape, and a second roller that is disposed inside the first roller and formed into a crown shape, in which an axially central portion thereof is larger in outer diameter than both end portions thereof.

The roller member may be disposed to be switchable between in a pressure contact state and in an out-of contact state with the rotation member. When the roller member is disposed in the out-of contact state, an inner surface of the first roller and an outer surface of the second roller may contact with each other in an axially central portion over an entire circumferential direction, and when the roller member is disposed in the pressure contact state, deflection of the second roller may bring the inner surface of the first roller into contact with the outer surface of the second roller over substantially an entire axial direction on the rotation member side.

The second roller may be provided with an elastic layer coated thereon.

According to further aspect of the invention, an image forming apparatus includes a toner image forming unit that forms a toner image, a transfer unit that transfers onto a recording medium the toner image formed by the toner image forming unit, and a fixing unit that fixes to the recording medium the toner image transferred onto the recording medium. The fixing unit includes a rotation member, and a pressure belt module that is provided with a pressure belt, a pressure roller supporting the pressure belt and pressing the rotation member, and a belt-supporting roller supporting the pressure belt. The pressure roller includes a first roller that is formed into a cylindrical shape, and a second roller that is disposed inside the first roller and formed into a crown shape, in which an axially central portion thereof is larger in outer diameter than both end portions thereof.

The pressure belt module may be configured to be capable of being in and out of contact with the rotation member. When the pressure belt module is disposed to be out of contact with the rotation member, an inner surface of the first roller and an outer surface of the second roller may contact with each other in the axially central portion over an entire circumferential direction, and when the pressure belt module is disposed in pressure contact with the rotation member, deflection of the second roller may bring the inner surface of the first roller into contact with the outer surface of the second roller over substantially an entire axial direction on the rotation member side.

As an example of application of the invention, there is an application to a fixing unit, that fixes an unfixed toner image carried on a recording medium, in an image forming apparatus such as a copy machine and a printer which use an electrophotographic method. There is also an application to a fixing unit, that dries an undried ink image carried on a recording medium, in an image forming apparatus such as a copy machine and a printer which use an inkjet method.

Although the present invention has been shown and described with reference to the embodiments, various changes and modifications will be apparent to those skilled in the art from the teachings herein. Such changes and modifications as are obvious are deemed to come within the spirit, scope and contemplation of the invention as defined in the appended claims.

The entire disclosure of Japanese Patent Application No. 2005-057033 filed on Mar. 2, 2005 including specification, claims, drawings and abstract is incorporated herein by reference in its entirety.

What is claimed is:

1. A fixing unit that fixes a toner image carried on a recording medium, the fixing unit comprising:

a rotation member; and a pressure belt module that is provided with a pressure belt, a pressure roller supporting the pressure belt and pressing the rotation member, and a belt-supporting roller supporting the pressure belt, wherein the pressure roller comprises:

a first roller that is formed into a cylindrical shape; and a second roller that is disposed inside the first roller and formed into a crown shape, in which an axially central portion thereof is larger in outer diameter than both end portions thereof.

2. The fixing unit according to claim 1, wherein an outer diameter of the second roller in the axially central portion is configured to be substantially equal to an inner diameter of the first roller.

3. The fixing unit according to claim 1, wherein the second roller is provided with an elastic layer coated thereon.

4. The fixing unit according to claim 1, wherein the pressure belt module is configured to be capable of being in and out of contact with the rotation member.

5. The fixing unit according to claim 4, wherein, when the pressure belt module is disposed to be out of contact with the rotation member, an inner surface of the first roller and an outer surface of the second roller contact with each other in the axially central portion over an entire circumferential direction.

6. The fixing unit according to claim 5, wherein a length in the axial direction of the contact area between the inner surface of the first roller and the outer surface of the second roller is 1/10 to 1/5 of an axial length of the first roller.

7. The fixing unit according to claim 4, wherein, when the pressure belt module is disposed in pressure contact with the rotation member, deflection of the second roller brings the inner surface of the first roller into contact with the outer surface of the second roller over substantially an entire axial direction on the rotation member side.

8. A fixing unit that fixes a toner image carried on a recording medium, the fixing unit comprising:

a rotation member;

a pressure roller that is disposed to be switchable between in a pressure contact state and in an out-of-contact state with the rotation member; and a pressure belt that is supported by the pressure roller and forms a nip portion with the rotation member, wherein the pressure roller comprises:

an outer roller supporting the pressure belt; and an inner roller that is disposed inside the outer roller and presses the outer roller toward the rotation member.

9. The fixing unit according to claim 8, wherein the inner roller is formed into a crown shape in which an axially central portion thereof is larger in outer diameter than both end portions thereof, the outer diameter of the axially central portion being substantially equal to an inner diameter of the outer roller.

10. The fixing unit according to claim 9, wherein the inner roller comprises:

a solid roller formed into a crown shape in which an axially central portion thereof is larger in outer diameter than both end portions thereof; and an elastic layer coated in uniform thickness on the solid roller.

11. The fixing unit according to claim 9, wherein the inner roller has a flat portion formed in the axially central portion.

12. The fixing unit according to claim 9, wherein, when the pressure roller is disposed in the out-of-contact state, an inner surface of the outer roller and an outer surface of the inner roller contact with each other in the axially central portion over an entire circumferential direction, and wherein, when the pressure roller is disposed in the pressure contact state, deflection of the inner roller brings the inner surface of the outer roller into contact with the outer surface of the inner roller over substantially an entire axial direction on the rotation member side.

13. The fixing unit according to claim 8, wherein the rotation member comprises:

a fixing roller that is rotatably provided;

a fixing belt that is supported and rotated by the fixing roller; and a belt-supporting roller that supports the fixing belt.

14. The fixing unit according to claim 8, wherein the outer roller is provided with an elastic layer formed thereon.

15. A roller member used in a fixing unit and pressable against a rotation member provided in the fixing unit, the roller member comprising:

a first roller that is formed into a cylindrical shape;

a second roller that is disposed inside the first roller and formed into a crown shape, in which an axially central portion thereof is larger in outer diameter than both end portions thereof wherein the roller member is disposed to be switchable between in a pressure contact state and in an out-of contact state with the rotation member, wherein when the roller member is disposed in the out-of contact state, an inner surface of the first roller and an outer surface of the second roller contact with each other in an axially central portion over an entire circumferential direction, and wherein when the roller member is disposed in the pressure contact state, deflection of the second roller brings the inner surface of the first roller into contact with the outer surface of the second roller over substantially an entire axial direction on the rotation member side.

16. The roller member according to claim 15, wherein the second roller is provided with an elastic layer coated thereon.

17. An image forming apparatus comprising:

a toner image forming unit that forms a toner image;

a transfer unit that transfers onto a recording medium the toner image formed by the toner image forming unit; and a fixing unit that fixes to the recording medium the toner image transferred onto the recording medium, the fixing unit including:

a rotation member; and a pressure belt module that is provided with a pressure belt, a pressure roller supporting the pressure belt and pressing the rotation member, and a belt-supporting roller supporting the pressure belt, wherein the pressure roller comprises:

a first roller that is formed into a cylindrical shape; and a second roller that is disposed inside the first roller and formed into a crown shape, in which an axially central portion thereof is larger in outer diameter than both end portions thereof.

18. The image forming apparatus according to claim 17, wherein the pressure belt module is configured to be capable of being in and out of contact with the rotation member, wherein, when the pressure belt module is disposed to be out of contact with the rotation member, an inner surface of the first roller and an outer surface of the second roller contact with each other in the axially central portion over an entire circumferential direction, and wherein, when the pressure belt module is disposed in pressure contact with the rotation member, deflection of the second roller brings the inner surface of the first roller into contact with the outer surface of the second roller over substantially an entire axial direction on the rotation member side.

* * * * *